United States Patent [19]

Hanson et al.

[11] 4,369,536

[45] Jan. 25, 1983

[54] APPARATUS FOR USE IN HEAT SETTING A LASTED SHOE UPPER

[75] Inventors: Raymond Hanson, Rearsby; Anthony M. White, Oadby, both of England

[73] Assignee: USM Corporation, Farmington, Conn.

[21] Appl. No.: 214,232

[22] Filed: Dec. 8, 1980

[30] Foreign Application Priority Data

Feb. 19, 1980 [GB] United Kingdom ..... 8005558

[51] Int. Cl.[3] ..... A43D 11/00

[52] U.S. Cl. ..... 12/1 A; 12/59.7

[58] Field of Search ..... 12/1 A, 41.5, 59.7

[56] References Cited

U.S. PATENT DOCUMENTS

| | | | |
|---|---|---|---|
| 3,220,033 | 11/1965 | Bromfield et al. | 12/1 A |
| 3,533,117 | 10/1970 | Dinolfo et al. | 12/1 A |
| 3,744,073 | 7/1973 | Nelson et al. | 12/1 A |
| 4,202,066 | 5/1980 | Hanson | 12/1 A |

*Primary Examiner*—Patrick D. Lawson

*Attorney, Agent, or Firm*—Donald N. Halgren

[57] ABSTRACT

The machine comprises a plurality of substantially enclosed channels in which a lasted shoe upper is subjected to hot air blown from both sides of the channel. Conveyors carry the uppers along the channels past inlets located at a distance of from 6 to 20 cms from the center-line of the lasted upper as it passes longitudinally along the channel. This arrangement enables air to be blown on to the uppers at high velocity. Moistening means may be provided to introduce moisture into the air before it is blown on to the uppers.

8 Claims, 3 Drawing Figures

APPARATUS FOR USE IN HEAT SETTING A LASTED SHOE UPPER

FIELD OF THE INVENTION

This invention is concerned with a machine for use in heat setting a lasted shoe upper.

PRIOR ART

Heat setting is an operation performed in the manufacture of shoes to hasten shape retention of a lasted shoe upper so that the time in which the shoe has to remain on the last can be reduced. Heat setting relieves the stresses set up in the upper during lasting but it must be ensured that the heat setting process does not lead to the upper shrinking.

Heat setting machines are known in which the lasted shoe upper is conveyed through one or more chambers in which it is subjected to heat or moisture or both heat and moisture simultaneously. Moisture serves to prevent moisture loss from the upper such as may lead to shrinkage. Many of these machines apply heat by blowing air at an elevated temperature on to the upper and are arranged to blow the air so that it impinges on the upper at a velocity of from 1 to 5 meters per second. These machines, however, suffer from the disadvantage that the heat setting process takes a relatively long time, often about 5 minutes.

It is an object of the present invention to provide apparatus for use in heat setting which enables faster heat setting to be performed than in the machines of the prior art.

BRIEF SUMMARY OF THE INVENTION

The present invention comprises a plurality of substantially enclosed channels having air inlets arranged along both sides thereof at a distance of from 6 to 20 cms from the center-line of a lasted shoe upper passing longitudinally along the channel. This arrangement allows the economic use of air at higher velocities than the velocities referred to above (the velocity may be in the range of 10 to 20 meters per second) thereby enabling faster heat setting to be achieved.

The invention provides apparatus for use in heat setting a lasted shoe upper comprising a plurality of substantially enclosed channels having air inlets arranged along both sides thereof at a distance of from 6 to 20 cms measured normally of the inlet from the center-line of a lasted shoe upper passing longitudinally along the channel, conveying means operable to convey lasted shoe uppers longitudinally along the channels, air blowing means operable to blow air through the inlets into the channels so that a lasted shoe upper passing through a channel is subjected to air blown thereonto from both sides of the channel, and heating means operable to heat the air blown by the air blowing means to an elevated temperature.

The requirement on the distance of the inlets from the center-line of the lasted shoe upper is determined, on the one hand, by the need for there to be sufficient clearance for the lasted shoe upper to pass through the channel and, on the other hand, by economic considerations. Since the further a jet of air has to be projected, the larger the inlet therefor needs to be, the further the inlet is from the upper, the more powerful the air flowing means must be.

Although a decrease in the time taken to heat set a lasted shoe upper is achieved when the air blowing means is operable to blow the air through the inlets at a velocity such that the air impinges on a lasted shoe upper in the channel at a velocity of at least 6 meters per second, it is found that the maximum rate of heat setting consistent with the use of economical air blowing means is achieved when the air impinges on the lasted shoe upper at a velocity of from 10 to 20 meters per second. Since at these velocities it is found that a satisfactory "set" can be achieved in from $1\frac{1}{2}$ to $2\frac{1}{2}$ minutes for most upper materials, it is advantageous if the conveying means is arranged to carry a lasted shoe upper through a channel in this time.

In order to provide a more economical arrangement in which the air blown into the channels is re-circulated to the air blowing means without the necessity for widening the channels to provide for air outlets, the conveying means comprises conveyor belts extending through the channels, the conveyor belts being permeable to air so that air can be sucked out of the channels through the belts.

Although heat setting may be carried out on some upper materials using dry air without causing shrinkage, this is not the case with all upper materials and, accordingly, to increase the versatility of the apparatus, it is desirable that the machine also comprises moistening means operable to add moisture to the air blown by the air blowing means.

In order to enable the apparatus to be used for heat setting the uppers of boots with high leg portions, it is advantageous if each of the channels has a lid which comprises two longitudinally-extending portions which are movable relative to one another transversely of the channel to provide a longitudinally-extending slot capable of supporting the leg portion of the lasted upper of a boot as the upper passes along the channel.

BRIEF DESCRIPTION OF THE DRAWINGS

The objects and advantages of the present invention will become more apparent when viewed in conjunction with the following drawings in which.

DESCRIPTION OF THE PREFERRED EMBODIMENT

Figure 1:
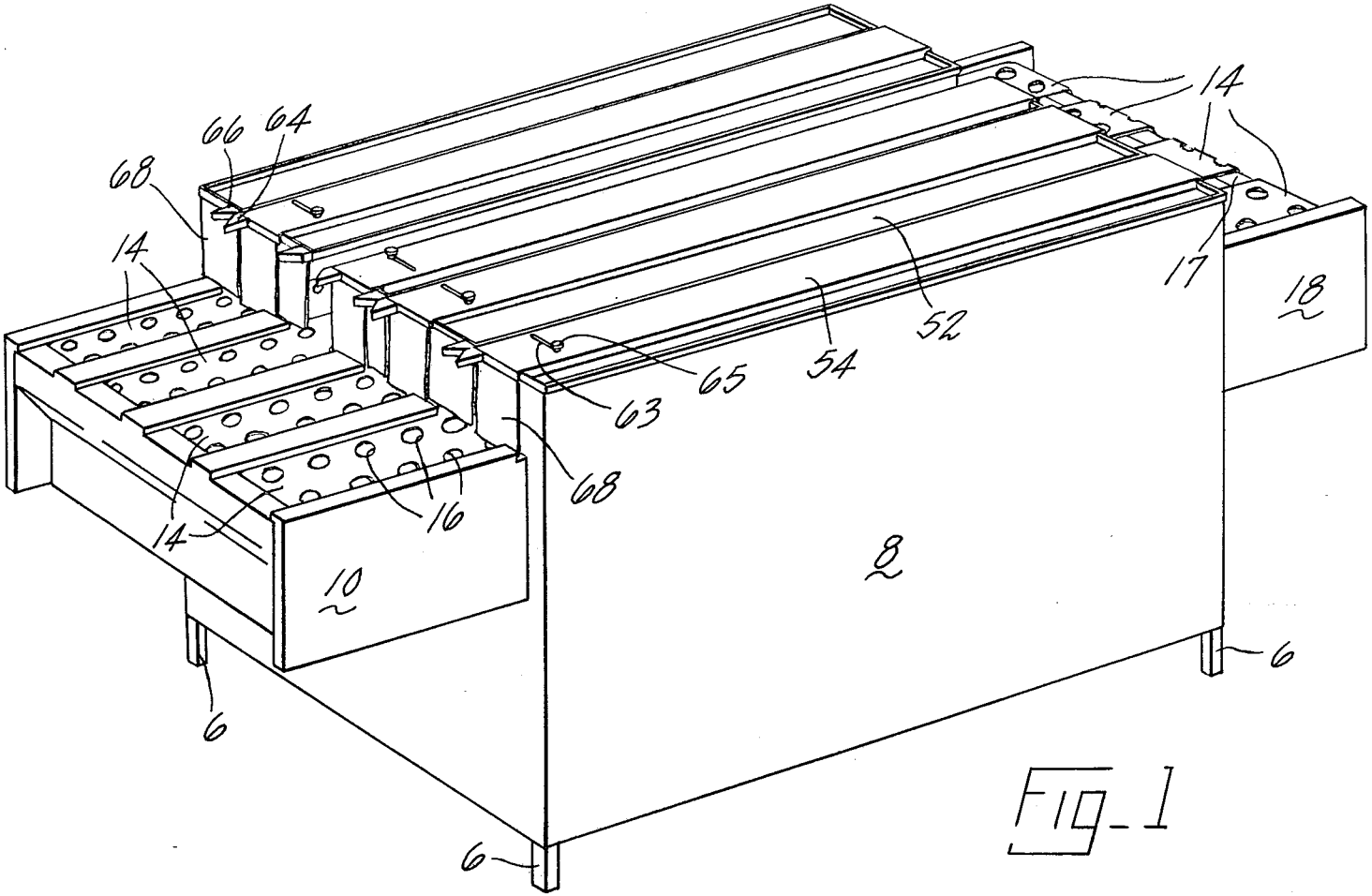
FIG. 1 is a perspective view of the present invention.
Figure 2:
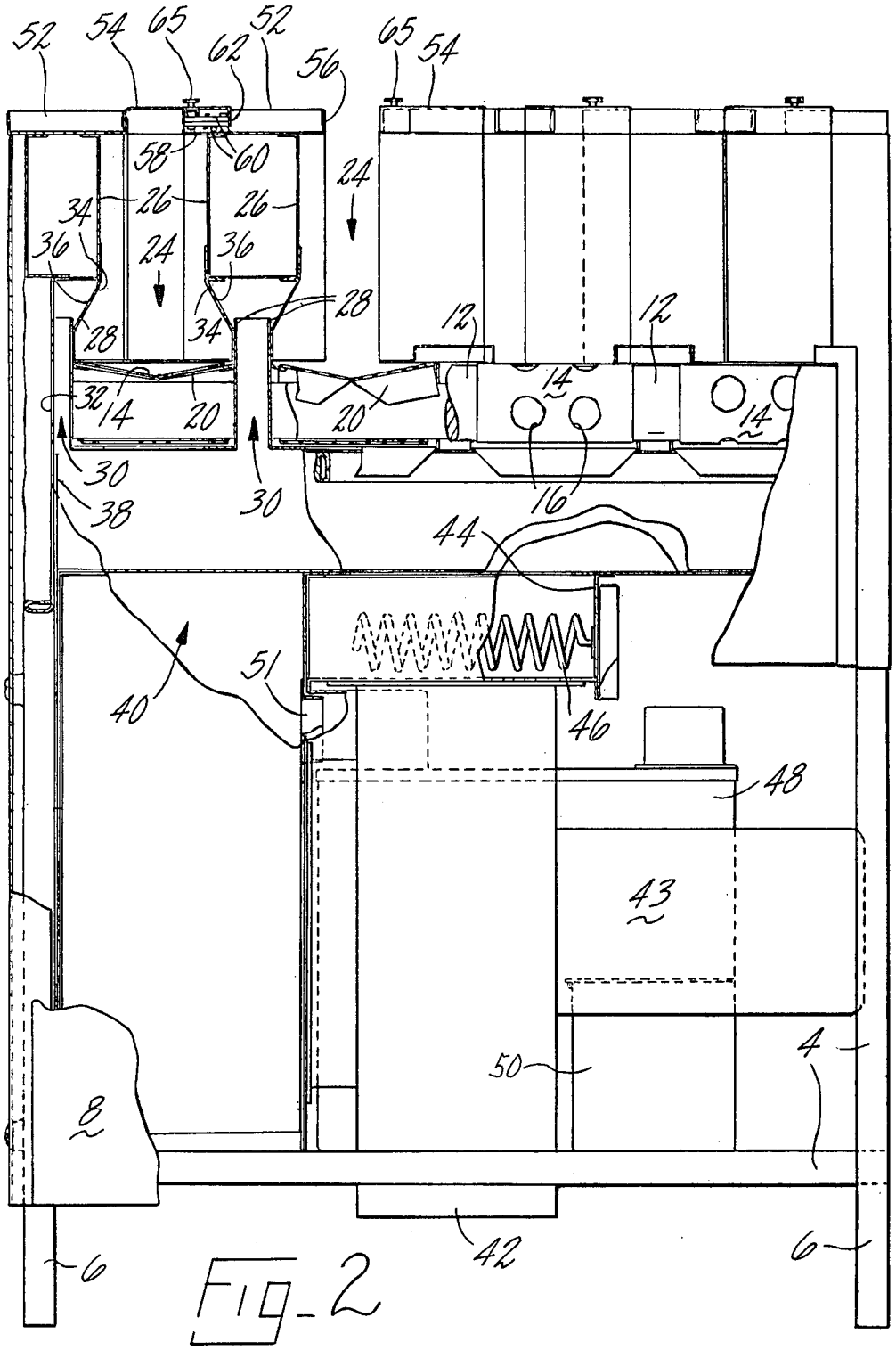
FIG. 2 is a front elevational view partly in section, on a larger scale than FIG. 1, of the present invention.

The heat setting machine of the present invention comprises a supporting framework 4 as shown in FIG. 2, supported by four legs 6. The framework 4 is enclosed by an arrangement of sheet metal panels 8 along its sides and at its ends. At a front portion of the apparatus, the framework 4 has a forward extension 10 which supports a roller 12, as shown in FIG. 2, around which a group of four conveyor belts 14 pass. The conveyor belts 14 each contain a plurality of circular holes 16 so that they are permeable to air.

The conveyor belts 14 extend longitudinally of the apparatus to a second roller 17 supported by a rearward extension 18 of the framework 4. The extension 18 also supports a motor, not shown, operable to drive the roller 17 so that the belts 14 pass around the rollers 12 and 17. Each of the belts 14 extends between the two rollers 12 and 17 along the upper surface of a metal plate 20 supported by the framework 4. Each of the metal plates 20 is bowed downwards towards its center (as shown in FIG. 2). This bowing assists in maintaining a lasted shoe upper in an upright condition as it passes along the channel. The metal plates 20 contain similar holes (not shown) to the holes 16 in the belts 14 so that the plates 20 are also permeable to air.

Where the belts 14 pass over the extension 10, they are accessible for an operator of the machine to place lasted shoe uppers thereon and, where the belts 14 pass over the extension 18, the belts 14 are accessible for an operator to remove the uppers therefrom. Between the extensions, however, the belts 14 each pass through a substantially enclosed channel 24. The heat setting machine thus may comprise a plurality, viz. four substantially enclosed channels having the conveyor belts 14 which provide conveying means of the machine, operable to convey lasted shoe uppers longitudinally along the channels 24.

Each of the channels 24 is of such a width that a lasted shoe upper can only pass along the channel 24 either toe or heel foremost, the width of each channel 24 of the present invention being about 16 cms. Thus, the uppers have to be conveyed longitudinally along the channels 24.

The channels 24 are formed between eight longitudinally extending metal plates 26, as shown in FIG. 2, which are supported by the framework 4. Each plate 26 comprises a vertical lower portion 28 which is closely adjacent to the belt 14. Six of these vertical lower portions 28 also act in pairs to define three vertical air passages 30 between the channels 24 and the two endmost portions 28 act with a pair of vertical plates 32, supported by the framework 4, to define two further vertical air passages 30 at the edges of the apparatus.

Above the lower vertical portion 28 thereof, each of the plates 26 has an inclined portion 34 which is inclined inwardly toward the center of the channel 24 formed by the plate 26. Each of the inclined portions 34 has a row of circular holes 36 therethrough which communicate with the air passage 30. The holes 36 provide air inlets of the present invention arranged along both sides of each channel at a distance of about 8 cms measured normally of the inlet from the center-line of a lasted shoe upper passing longitudinally along the channel 24 and arranged centrally on the conveyor belt 14. Although the distance is about 8 cms in the present invention, distances in the range of from about 6 cms to about 20 cms could be used in modifications thereof. A distance of 6 cms is necessary to allow clearance for uppers of large sizes and as the distance increases so the diameter of the holes 36 must be increased, hence making it necessary to blow greater quantities of air. It is considered that distances above about 20 cms would be uneconomical. However, it is believed that a distance in the range of from about 8 to about 10 cms is the most advantageous. In the present invention the holes 36 have a diameter of about 1.9 cms.

The air passages 30 communicate at their lower ends with a chamber 38 as shown in FIG. 2, which is enclosed by metal plates supported by the framework 4. The chamber 38 extends beneath the plates 20 transversely across the machine in a central region thereof so that the communication between the passages 30 and the chamber 38 is in a central region of the passages 30. Beneath the two end portions of each channel 24, two further chambers, not shown, extend transversely of the apparatus on either side of the chamber 38. These chambers communicated with the channels 24 through the holes in the plates 20 and the holes 16 in the belts 14 but do not communicate with the passages 30. These two chambers in turn communicate with a chamber 40 which extends longitudinally beneath these chambers and the chamber 38 on the left hand side of the apparatus, viewing FIG. 2.

The heat setting machine also comprises air blowing means operable to blow air through the inlets formed by the holes 36 into the channels 24 so that a lasted shoe upper passing through a channel 24 is subjected to air blown thereonto from both sides of the channel 24. The air blowing means comprises a fan 42 driven by a motor 43 mounted on the framework 4 adjacent to the chamber 40, as shown in FIG. 2. The fan 42 is arranged to suck air out of the chamber 40 through a hole in the right-hand wall thereof and blow it into the chamber 38 through an opening 44 therein. As it enters the chamber 38, the air passes around a plurality of electrical heaters 46 which provide heating means operable to heat the air blown by the air blowing means to an elevated temperature of about 125 degrees centigrade.

The fan 42, as mentioned above, blows air into the chamber 38 from whence the air passes up the passages 30 and is blown through the holes 36 into the channels 24 where it impinges on any lasted shoe uppers passing the holes 36. The air is then sucked out of the channels 24 through the holes in the belts 14 and the plates 20 into the two aforementioned chambers and thence to the chamber 40 for recirculation.

A moistening means is operable to add moisture to the air blown by the air blowing means. The moistening means comprises a boiler 48 supplied by a water tank 50, shown in FIG. 2. The boiler 48 boils water and supplies steam to the chamber 40 through an opening 51. The boiler 48 can be used optionally to add a water content to the air at a dew point of about 60 degrees centigrade (i.e. the quantity of water that would saturate air at 60 degrees centigrade).

Figure 3:
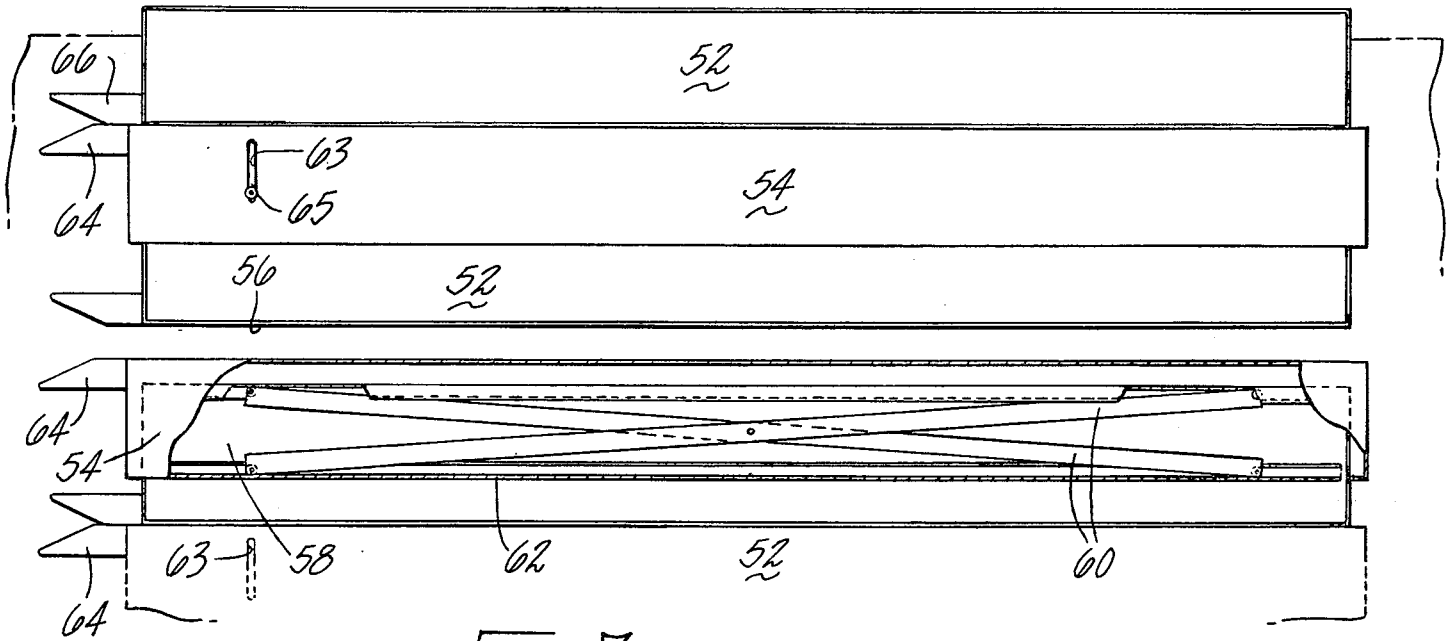
FIG. 3 is a plan view of a portion of the present invention with parts broken away.

Each of the channels 24 has a lid which comprises two longitudinally-extending horizontal lid portions 52 and 54, shown in FIGS. 2 and 3. The lid portions 52 and 54 are movable relative to one another transversely of the channel 24 to provide a longitudinally-extending slot 56 capable of supporting the leg portion of the lasted upper of a boot as the upper passes along the channel 24. The lid portion 52 on the left viewing FIGS. 2 and 3, is fixed on the framework 4 while the other lid portion 54 is slidable towards and away from the lid portion 52 on a plate 58. The lid portion 54 has a motion-equalizing mechanism associated therewith which comprises two levers 60 pivoted together at their centers and having one end bearing on the lid portion 54 and the other end bearing on an upstanding flange 62 of the plate 58, shown in FIG. 3. The levers 60 ensure that the lid portion 54 remains parallel to the lid portion 52 and can be moved towards or away from the lid portion 52 by means of a handle 64 at the end of the lid portion 54. The handle 64 has an inclined surface which cooperates with a similar surface on a projection 66 of the lid portion 52 to provide a "lead-in" for the leg portion into the slot 56. The surfaces of the lid portions 52 and 54 which border the slot 56 are coated with non-stick material to ensure that the leg portion will pass readily along the slot 56. The non-stick material is polytetrafluoroethylene. A slot 63 and screw 65 arrangement is provided for locking the lid portion 54 in position.

The fan 42 is operable to blow the air through the holes 36 at a velocity such that the air impinges on a lasted shoe upper in one of the channels at a velocity of at least 6 meters per second. However, since the time taken to achieve satisfactory heat setting reduces as the velocity of the air increases to a limit reached at about 20 meters per second, a velocity of from about 10 to 20 meters per second is preferable. It is found that at these velocities, satisfactory heat settings can be achieved for most upper materials in between one and a half and two and a half minutes so the conveying means is arranged to carry a lasted shoe upper through a channel 24 in a time within this range.

In order to reduce heat losses from the channels 24, the ends of the channels are closed by an arrangement of curtains 68 which an upper pushes aside when it reaches them.

We claim:

1. A machine for use in heat setting a lasted shoe upper, said machine comprising:

a plurality of substantially enclosed channels having air inlets arranged along both sides thereof;

conveying means operable to convey lasted shoe uppers longitudinally along the channels;

air blowing means and air moistening means operable to blow moistenable air through the inlets into the channels so that a lasted shoe upper passing through a channel is subjected to air blown thereonto from both sides of the channel; and heating means operable to heat the air blown by the air blowing means to an elevated temperature.

2. A machine for use in heat setting a shoe upper as recited in claim 1, wherein said inlets are at a distance of from about 6 to 20 cms measured normally of the inlet from the center-line of a lasted shoe upper passing longitudinally along the channel.

3. A machine for use in heat setting a shoe upper as recited in claim 2 wherein the air blowing means is operable to blow the air through said inlets at a velocity such that the air impinges on a lasted shoe upper in one of the channels at a velocity of at least about 6 meters per second.

4. A machine for use in heat setting a shoe upper as recited in claim 3 wherein the air impinges on the lasted shoe upper at a velocity of from about 10 to 20 meters per second.

5. A machine for use in heat setting a shoe upper as recited in claim 4 wherein said conveying means is arranged to carry a lasted shoe upper through a channel in a time ranging from about $1\frac{1}{2}$ to $2\frac{1}{2}$ minutes.

6. A machine for use in heat setting a shoe upper as recited in claim 5 wherein said conveying means comprises conveyor belts extending through said channels, the conveyor belts being permeable to air so that air can be sucked out of the channels through said belts.

7. A machine for use in heat setting a shoe upper as recited in claim 5 wherein each of the channels has a lid which comprises two longitudinally-extending portions which are movable relative to one another transversely of the channel to provide a longitudinally-extending slot capable of supporting the leg portion of the lasted upper of a boot as the upper passes along the channel.

8. A machine for use in heat setting a shoe upper as recited in claim 7 wherein the surfaces of the longitudinally-extending portions of said lid which border said slot are coated with non-stick material.

* * * * *